US009899157B1

(12) United States Patent
Yen et al.

(10) Patent No.: US 9,899,157 B1
(45) Date of Patent: Feb. 20, 2018

(54) KEY DEVICE AND MULTI-LEGGED SUPPORTING BALANCE BAR STRUCTURE THEREOF

(71) Applicants: LITE-ON ELECTRONICS (GUANGZHOU) LIMITED, Guangzhou (CN); LITE-ON TECHNOLOGY CORPORATION, Taipei (TW)

(72) Inventors: Ming-Fu Yen, New Taipei (TW); Chun-Lin Chen, Taipei (TW); Xiao-Qiang Liang, Chang Zhou (CN); Lei Shi, Chang Zhou (CN)

(73) Assignees: LITE-ON ELECTRONICS (GUANGZHOU) LIMITED, Guangzhou (CN); LITE-ON TECHNOLOGY CORPORATION, Taipei (TW)

( * ) Notice: Subject to any disclaimer, the term of this patent is extended or adjusted under 35 U.S.C. 154(b) by 0 days.

(21) Appl. No.: 15/384,213

(22) Filed: Dec. 19, 2016

(30) Foreign Application Priority Data

Aug. 12, 2016 (CN) ..... 2016 1 0663340

(51) Int. Cl.
*H01H 3/12* (2006.01)

(52) U.S. Cl.
CPC ..... *H01H 3/122* (2013.01)

(58) Field of Classification Search
CPC ..... B41J 5/12; B41J 5/14; B41J 5/26; H01H 3/122
See application file for complete search history.

(56) References Cited

U.S. PATENT DOCUMENTS

| | | | | |
|---|---|---|---|---|
| 4,830,526 | A * | 5/1989 | Hosono | B41J 5/12 400/472 |
| 2002/0064410 | A1* | 5/2002 | Lin | H01H 3/122 400/490 |
| 2007/0172288 | A1* | 7/2007 | Lai | B41J 5/12 400/490 |
| 2008/0075516 | A1* | 3/2008 | Hou | H01H 3/125 400/477 |
| 2012/0162873 | A1* | 6/2012 | Luo | H01H 3/122 361/679.01 |
| 2014/0216905 | A1* | 8/2014 | Ma | H01H 3/122 200/344 |
| 2016/0055989 | A1* | 2/2016 | Hsu | H01H 13/14 200/344 |
| 2016/0064165 | A1* | 3/2016 | Chao | H01H 13/14 200/344 |
| 2016/0329166 | A1* | 11/2016 | Hou | H01H 3/122 |
| 2017/0194109 | A1* | 7/2017 | Ren | H01H 3/122 |

* cited by examiner

*Primary Examiner* — Albert K Wong
(74) *Attorney, Agent, or Firm* — Li & Cai Intellectual Property (USA) Office

(57) ABSTRACT

A key device includes a base plate, a key cap and at least one balance bar. The at least one balance bar is with a tabular body and is disposed between the base plate and the key cap. The at least one balance bar has an elongated rod and a plurality of supporting legs connected to the elongated rod and protruded from a lower edge of the elongated rod. The elongated rod is connected to the key cap. The plurality of supporting legs is connected to the base plate.

12 Claims, 5 Drawing Sheets

KEY DEVICE AND MULTI-LEGGED SUPPORTING BALANCE BAR STRUCTURE THEREOF

BACKGROUND OF THE INVENTION

1. Field of the Invention

The instant disclosure relates to a key device and a multi-legs supporting balance bar structure thereof; in particular, to a balance bar structure adapted in a key device or other entering devices.

2. Description of Related Art

In current computer keyboards, a balance bar is designed for the multiple keys or the function keys having a larger aspect ratio. The balance bar is made of a metal material with a circular cross section, one end of the balance bar is pivoted to a key cap, and the other end of the balance bar is slidably disposed on a base plate, so as to build up a balancing mechanism. When the key is pressed, the balancing mechanism can be used to maintain the key cap in a horizontal plane relative to the base plate during actuation by the balance bar sliding relative to the base plate and pivoting relative to the key cap. Thereby the key cap being flipped during actuation to reduce the sensitivity of triggering the keys can be avoided.

The trend of the existing laptop market is toward the total height of the keyboard being thinner but the press stroke being longer. Under the limitations of the interior space of the structure and the structural deformation of the plastic material, when the corner of a long form key is pressed, the key cap is flipped during actuation because the supporting point is insufficient, and the conduction point at the middle of the key is hard to synchronize down, so as to reduce the sensitivity of triggering the keys.

In summary, the present inventors have felt the above features can be improved upon, and with painstaking research and with theoretical application, have finally put forward a reasonably designed and effectively improved structure for the above keys.

SUMMARY OF THE INVENTION

The technical problem of the instant disclosure to be solved is to provide a key device and a multi-legged supporting balance bar structure thereof. It can improve the problem of the current balance bar with an insufficient supporting point, such that the key cap is not flipped during actuation to upgrade the sensitivity of triggering the keys.

In order to solve the above technical problem, the instant disclosure provides a key device including a base plate, a key cap and at least one balance bar. The at least one balance bar is with a tabular body and is disposed between the base plate and the key cap. The at least one balance bar has an elongated rod and a plurality of supporting legs connected to the elongated rod and protruded from a lower edge of the elongated rod. The elongated rod is connected to the key cap. The plurality of supporting legs is connected to the base plate.

In order to solve the above technical problem, the instant disclosure further provides a multi-legged supporting balance bar structure of a key device which is with a tabular body, and has an elongated rod and a plurality of supporting legs connected to the elongated rod and protruded from a lower edge of the elongated rod.

In addition, a width of a mid-position is larger than or same a width of a position at both sides of the elongated rod, such that a reinforcement portion is formed at a mid-position of the elongated rod, and the reinforcement portion is located near the mid-position of the elongated rod between the two supporting legs.

Preferably, the supporting legs are disposed on the balance bar, and formed into a left and right symmetrical form along an intermediate point of the balance bar in a length direction.

This instant disclosure has the following advantages:

The balance bar of the instant disclosure has a plurality of supporting legs for connecting to the base plate to form multi-legged support which can provide superior support and enhance the problem of the current balance bar having an insufficient supporting point, such that the key cap is not flipped during actuation, so as to upgrade the sensitivity of triggering the keys.

Furthermore, the elongated rod of this instant disclosure is formed with the reinforcement portion located near the mid-position between the two supporting legs, and it can provide a reinforcing function to increase an intensity of the balance bar.

Additionally, since the supporting legs of this instant disclosure are disposed on the balance bar and formed into a left and right symmetrical form along the intermediate point of the balance bar in the length direction, a supporting intensity of left and right two sides of the balance bar can be more even.

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

DETAILED DESCRIPTION OF THE PREFERRED EMBODIMENTS

Embodiments disclosed in the instant disclosure are illustrated via specific examples as follows, and people familiar in the art may easily understand the advantages and efficacies of the instant disclosure by the disclosure of the specification. The instant disclosure may be implemented or applied by other different specific examples, and each of the details in the specification may be applied based on different views and may be modified and changed under the existence of the spirit of the instant disclosure. The figures in the instant disclosure are only for brief description, but they are not depicted according to actual size and do not reflect the actual size of the relevant structure. The following embodiments further illustrate related technologies of the instant disclosure in detail, but the scope of the instant disclosure is not limited herein.

Figure 1:
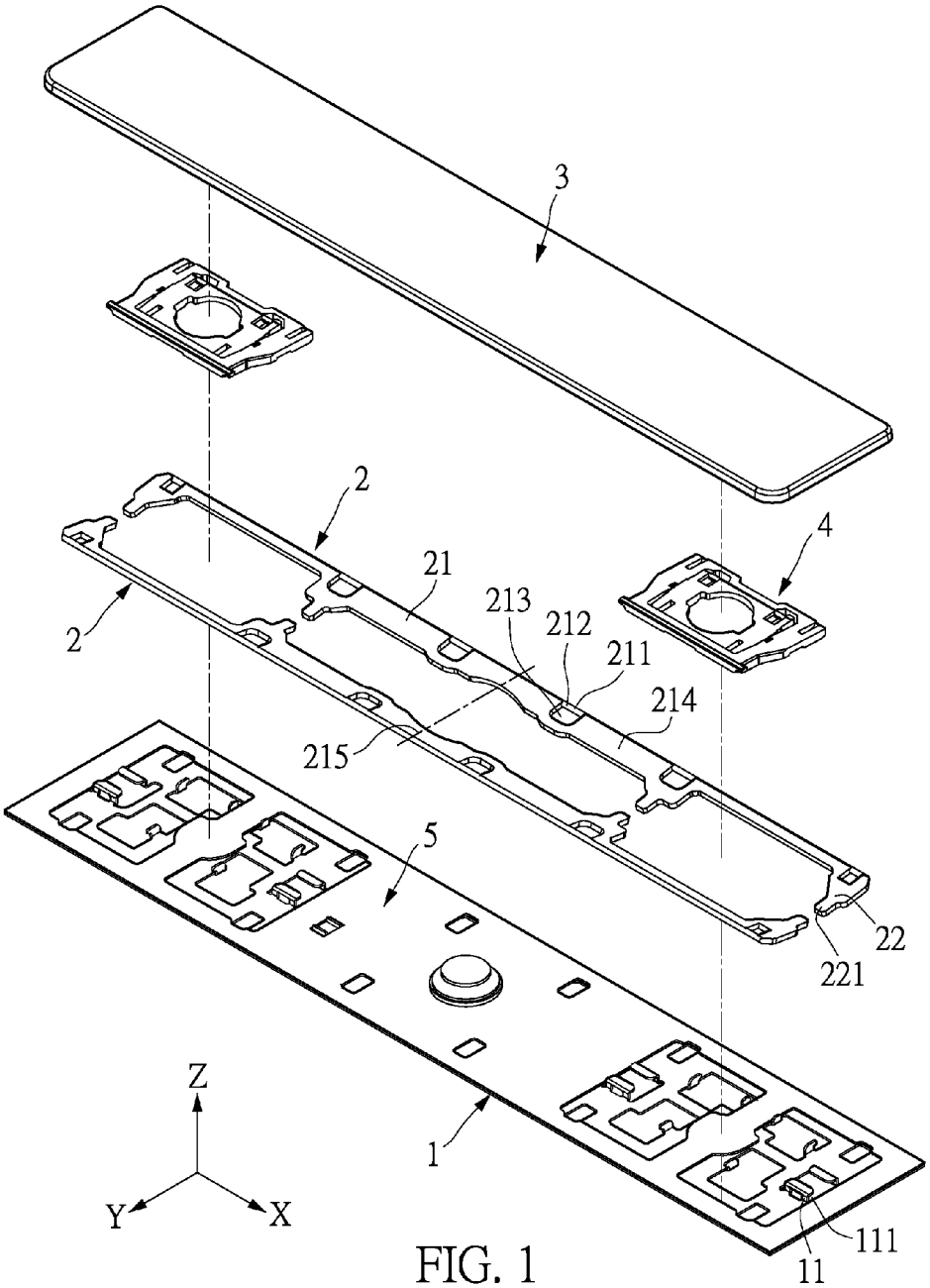
FIG. 1 shows an exploded perspective view of a key device of an embodiment of this instant disclosure.
Figure 2:
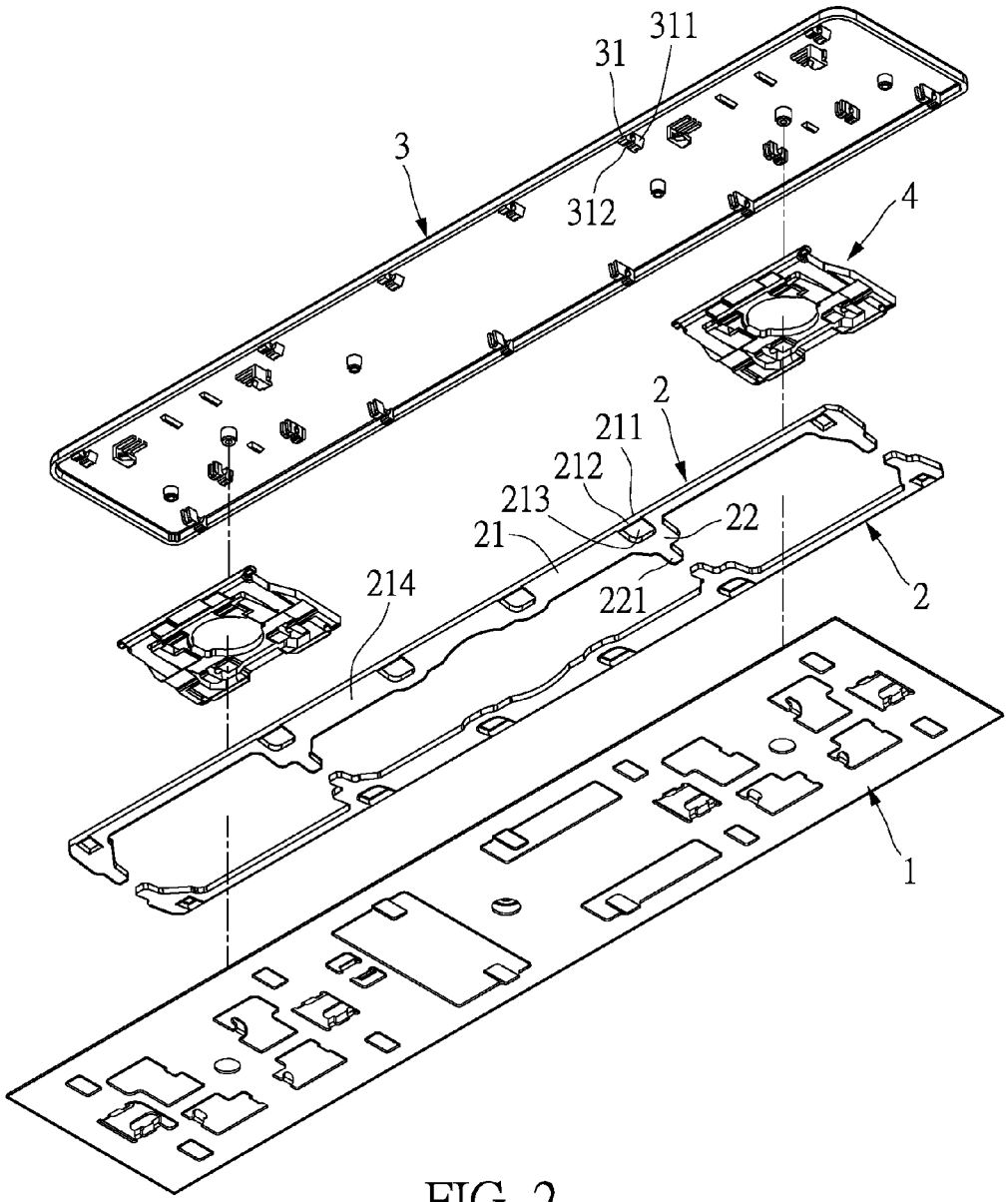
FIG. 2 shows an exploded perspective view of a key device of another view of an embodiment of this instant disclosure.

Please refer to FIG. 1 and FIG. 2. The instant disclosure provides a key device which may be adapted in a key device or other entering devices. The key device includes a base plate 1, at least one balance bar 2 and a key cap 3.

The base plate 1 may be made of a metal plate or other suitable materials. A scissor element 4 also may be further disposed between the base plate 1 and the key cap 3. The scissor element 4 is a double parallel link mechanism which can be used to guide the key cap 3 moving up and down, and can balance a force applied on each of the keys provided by a user. A conductive film 5 may be disposed on the base plate 1. In the drawings of this embodiment, the base plate 1 and the conductive film 5 are depicted as a single entity, but actually there are a plurality of key devices in one keyboard, the base plate 1 of the plurality of key devices are connected into one piece, and the conductive film 5 is also connected into one piece. There are one or two balance bars 2 that may be disposed. This embodiment discloses at least two balance bars 2, but the number of the balance bar 2 is not limited herein. The balance bar 2 is with a tabular body, and may be designed into an elongated body corresponding to a length of the key cap 3. The balance bar 2 is disposed between the base plate 1 and the key cap 3, and the balance bar 2 having an upper end is connected to the key cap 3 and the balance bar 2 having a lower end is connected to the base plate 1. In this embodiment, the upper end of the balance bar 2 is pivoted to the key cap 3, and the lower end of the balance bar 2 is slidably connected to the base plate 1. However, the manner for connecting the balance bar 2, the base plate 1 and the key cap 3 is not limited herein, and it may be modified as required. For example, the upper end of the balance bar 2 also may be slidably connected to the key cap 3, and the lower end of the balance bar 2 also may be pivoted to the base plate 1.

The balance bar 2 has an elongated rod 21 and a plurality of supporting legs 22. The elongated rod 21 and the supporting leg 22 may be made of a metal material. The elongated rod 21 and the supporting leg 22 may be formed by stamping with metal powder or metal. The balance bar 2 may have three, four, or five, or more plurality of supporting legs 22, and the number is not limited herein. The plurality of supporting legs 22 is alternately disposed, and may be equally spaced or unequally spaced. These supporting legs 22 are disposed on the balance bar 2, and preferably formed into a left and right symmetrical form along an intermediate point of the balance bar 2 in a length direction, such that a supporting intensity of left and right two sides of the balance bar 2 can be more even. These supporting legs 22 are connected to the elongated rod 21 and protrude from a lower edge of the elongated rod 21.

In addition, one end of these supporting legs 22 distanced from the elongated rod 21 of the balance bar 2 may be connected to the base plate 1, and the elongated rod 21 of the balance bar 2 may be connected to the key cap 3. A width of a mid-position may be larger than or approximately the same a width of a position at either of both sides of the elongated rod 21, such that a reinforcement portion 214 is formed at the mid-position of the elongated rod 21, and the reinforcement portion 214 is located near the mid-position of the elongated rod 21 between the two supporting legs 22, so as to provide a reinforcing function.

Specifically, each of the supporting legs 22 has a first sliding contact portion 221, and the structure of the first sliding contact portion 221 is not limited herein. In this embodiment, the first sliding contact portion 221 is a sheet body protruded from one end of the supporting leg 22, and the width of the first sliding contact portion 221 is smaller than the width of the supporting leg 22, making the supporting leg 22 be formed into the sheet body with a wider top and narrower bottom. A first pivoting portion 211 is formed on the elongated rod 21, and the structure of the first pivoting portion 211 is not limited herein. In this embodiment, there are a plurality of first pivoting portions 211 formed on the elongated rod 21, each of the plurality of first pivoting portions 211 contains a pivot axis 212 with a cylindrical shape. These pivot axes 212 also may be further connected into one piece, and a perforation 213 is respectively disposed on the elongated rod 21 adjacent to each of these pivot axes 212.

Figure 4:
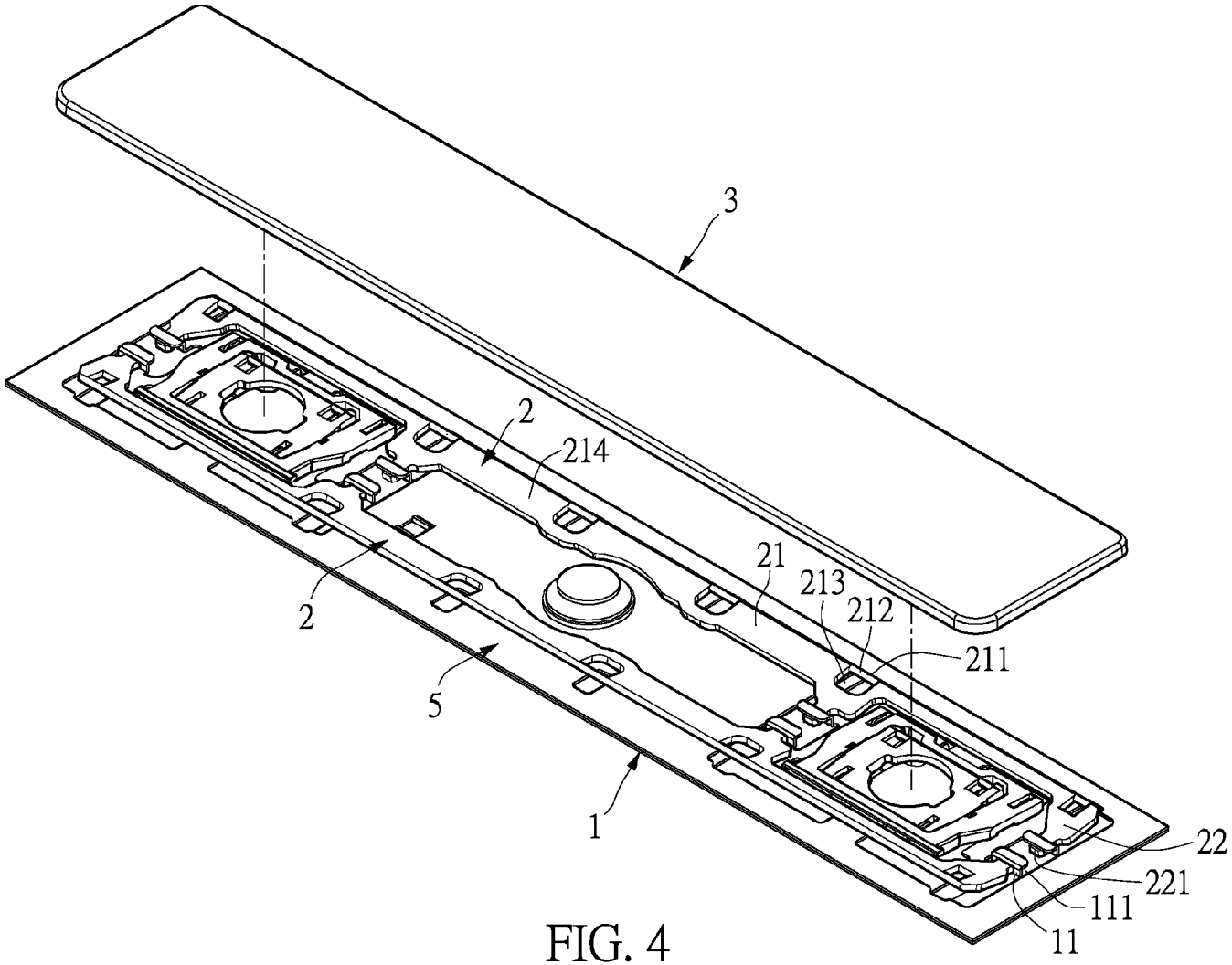
FIG. 4 shows a perspective view of a key cap of a key device in a separated state of an embodiment of this instant disclosure.
Figure 5:
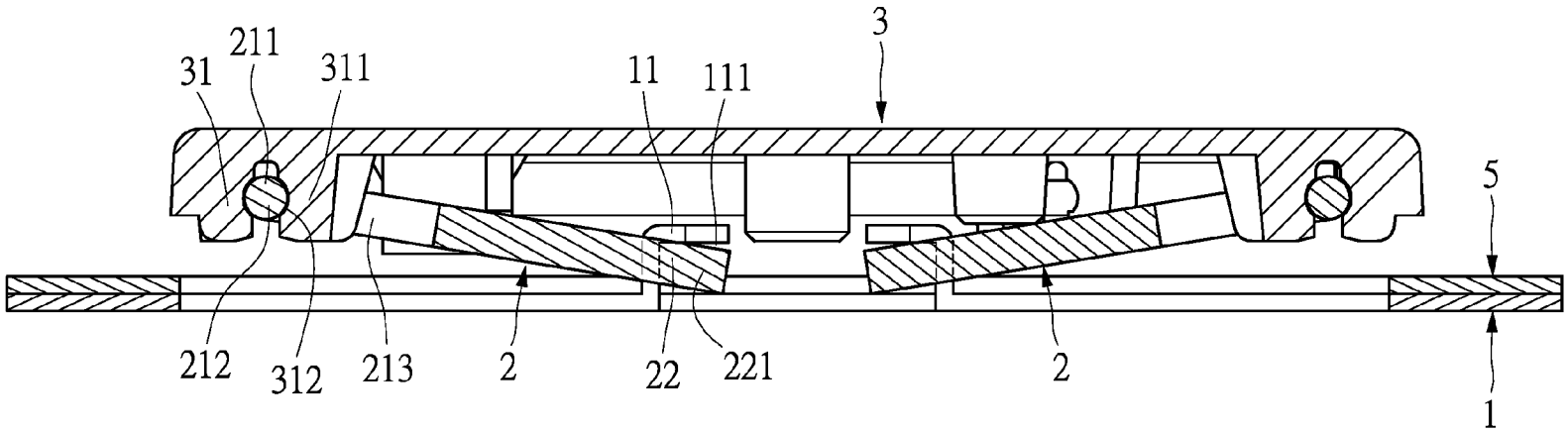
FIG. 5 shows a sectional view of a key device of an embodiment of this instant disclosure.

In addition, a second pivoting portion 11 may be formed on the base plate 1 corresponding to the first pivoting portion 221. The second pivoting portion 11 is formed from the base plate 1, and the structure of the second pivoting portion 11 is not limited herein. In this embodiment, the second pivoting portion 11 is bent into an L-form sheet body, and a chute 111 may be disposed thereto. The first sliding contact portion 221 of the balance bar 2 may be slidably disposed on the corresponding second sliding contact portion 11 on the base plate 1 (as shown in FIG. 4 and FIG. 5). That is, the first sliding contact portion 221 may be disposed in the chute 111, such that the lower end of the balance bar 2 is slidably connected to the base plate 1, and the first sliding contact portion 221 can be slidably moved in a forward and backward direction (as shown in a Y axis direction in FIG. 1). In another embodiment, the structures of the first sliding contact portion 221 and the second sliding contact portion 11 also may be exchanged, or replaced with other sliding structures.

Figure 3:
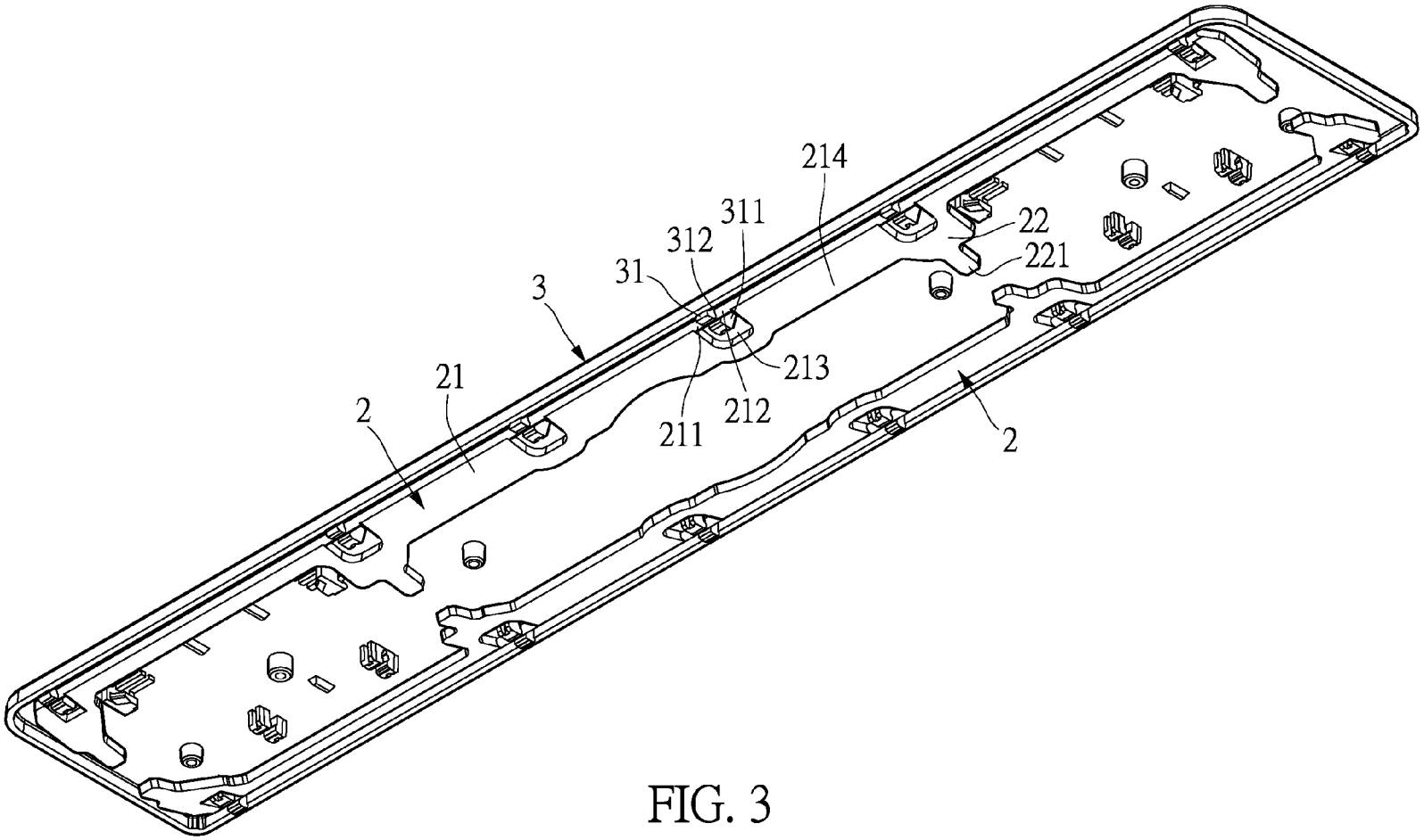
FIG. 3 shows a perspective view of a balance bar and a key cap of a key device of an embodiment of this instant disclosure.

In addition, the key cap 3 may be disposed with a second pivoting portion 31 corresponding to the first pivoting portion 211. The second pivoting portion 31 is formed from the key cap 3 and may be disposed at an edge of a bottom surface of the key cap 3, and the structure of the second pivoting portion 31 is not limited herein. In this embodiment, a plurality of the second pivoting portions 31 is disposed on the key cap 3, each of the second pivoting portions 31 contains a seat body 311 protruded from the bottom surface of the key cap 3 and a pivot hole 312 disposed in the seat body 311, and a bottom portion of the seat body 311 has a widening shape. The first pivoting portion 211 of the balance bar 2 may be pivoted to the corresponding second pivoting portion 31 on the key cap 3 (as shown in FIG. 3 and FIG. 5). That is, these pivot axes 212 may be pivoted into the corresponding pivot holes 312, such that the upper end of the balance bar 2 can be pivoted to the key cap 3. Furthermore, these seat bodies 311 may be respectively received in these perforations 213, such that the balance bar 2 and the key cap 3 have superior stiffness therebetween. In another embodiment, the structures of the first pivoting portion 211 and the second pivoting portion 31 also may be exchanged, or replaced with other pivoting structures.

When the key device is pressed, the force applied on the key cap 3 can be evenly distributed on whole key cap 3 by a balancing mechanism constituted from the balance bar 2, so as to maintain the key cap 3 in a horizontal plane relative to the base plate 1 during actuation, thereby the key cap 3 being flipped during actuation to reduce the sensitivity of triggering the keys can be avoided. The abovementioned balance bar 2 can be used for strengthening a left and right (as shown in a X axis direction in FIG. 1) interlocking pressing, and a superior interlocking effect can be achieved.

A plate shape is adopted in the balance bar of this instant disclosure. It can replace the current balance bar which has a circular cross-section, and a strength advantage of a plate-like geometry can be obtained. Therefore, the balance bar with a thinner thickness of this instant disclosure can have the strength of the balance bar currently in use. Thus, the four corners of the key device having the best pressing hand-touch feeling can be effectively achieved by the geometric strength in a limited space, and the custom pressing hand-touch feeling can be kept. Thus the hand-touch feeling can be more stable, and space can be effectively saved, as to achieve a thinning effect.

The balance bar of this instant disclosure has a plurality of supporting legs connected to the base plate to form a multi-legged supporting unit. It provides superior support and enhances the problem of the current balance bar having an insufficient supporting point, such that the key cap is not flipped during actuation, so as to upgrade the sensitivity of triggering the keys.

Furthermore, the elongated rod of this instant disclosure is formed at the mid-position. The reinforcement portion is located near the mid-position between the two supporting legs, and it can provide a reinforcing function to increase an intensity of the balance bar.

The descriptions illustrated supra set forth simply the preferred embodiments of the instant disclosure; however, the characteristics of the instant disclosure are by no means restricted thereto. All changes, alterations, or modifications conveniently considered by those skilled in the art are deemed to be encompassed within the scope of the instant disclosure delineated by the following claims.

What is claimed is:

1. A key device, comprising:

a base plate;

a key cap; and at least one balance bar with a tabular body and disposed between the base plate and the key cap, the at least one balance bar having an elongated rod and a plurality of supporting legs connected to the elongated rod and protruded from a lower edge of the elongated rod, the elongated rod connected to the key cap, and the plurality of supporting legs connected to the base plate.

2. The key device as claimed in claim 1, wherein a first pivoting portion is formed on the elongated rod, a second pivoting portion is formed on the key cap corresponding to the first pivoting portion, the first pivoting portion is pivoted to the corresponding second pivoting portion, each of the plurality of supporting legs has a first sliding contact portion, the base plate is disposed with a plurality of second sliding contact portions corresponding to the first sliding contact portions which are slidably disposed on the corresponding plurality of second sliding contact portions.

3. The key device as claimed in claim 2, wherein a plurality of the first pivoting portions is formed on the elongated rod, each of the first pivoting portions contains a pivot axis with a cylindrical shape, a perforation is respectively disposed on the elongated rod adjacent to each of these pivot axis, a plurality of the second pivoting portions is disposed on the key cap, each of the second pivoting portions contains a seat body protruded from a bottom surface of the key cap and a pivot hole disposed in the seat body, these pivot axes are respectively pivoted in the corresponding pivot holes, and the seat bodies is respectively received in the perforations.

4. The key device as claimed in claim 1, wherein a width of a mid-position is approximately the same a width of a position at both sides of the elongated rod.

5. The key device as claimed in claim 1, wherein a width of a mid-position is larger than a width of a position at both sides of the elongated rod, such that a reinforcement portion is formed at the mid-position of the elongated rod, and the reinforcement portion is located near the mid-position of the elongated rod between the two supporting legs.

6. The key device as claimed in claim 1, wherein the supporting legs are disposed on the balance bar, and formed into a left and right symmetrical form along an intermediate point of the balance bar in a length direction.

7. A multi-legged supporting balance bar structure of a key device is with a tabular body, and has an elongated rod and a plurality of supporting legs connected to the elongated rod and protruded from a lower edge of the elongated rod.

8. The multi-legged supporting balance bar structure of the key device as claimed in claim 7, wherein each of the plurality of supporting legs has a first sliding contact portion, and a first pivoting portions is formed on the elongated rod.

9. The multi-legged supporting balance bar structure of the key device as claimed in claim 8, wherein a plurality of the first pivoting portions is formed on the elongated rod, each of the first pivoting portions contains a pivot axis with a cylindrical shape, a perforation is respectively disposed on the elongated rod adjacent to each of these pivot axes.

10. The multi-legged supporting balance bar structure of the key device as claimed in claim 7, wherein a width of a mid-position is approximately the same a width of a position at both sides of the elongated rod.

11. The multi-legged supporting balance bar structure of the key device as claimed in claim 7, wherein a width of a mid-position is larger than a width of a position at both sides of the elongated rod, such that a reinforcement portion is formed at the mid-position of the elongated rod, and the reinforcement portion is located near the mid-position of the elongated rod between the two supporting legs.

12. The multi-legged supporting balance bar structure of the key device as claimed in claim 7, wherein the supporting legs are disposed on the balance bar, and formed into a left and right symmetrical form along an intermediate point of the balance bar in a length direction.

* * * * *